US009574827B2

(12) United States Patent
Troutman

(10) Patent No.: US 9,574,827 B2
(45) Date of Patent: Feb. 21, 2017

(54) MICROCHANNEL COIL MANIFOLD SYSTEM

(75) Inventor: Stephen Troutman, Stone Mountain, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 1220 days.

(21) Appl. No.: 12/750,914

(22) Filed: Mar. 31, 2010

(65) Prior Publication Data

US 2011/0139423 A1 Jun. 16, 2011

Related U.S. Application Data

(60) Provisional application No. 61/286,851, filed on Dec. 16, 2009.

(51) Int. Cl.

| | |
|---|---|
| ***F28F 9/26*** | (2006.01) |
| ***F28D 1/04*** | (2006.01) |
| ***F25B 39/04*** | (2006.01) |
| ***F28B 1/06*** | (2006.01) |

(52) U.S. Cl.

CPC ..... *F28D 1/0417* (2013.01); *F25B 39/04* (2013.01); *F28B 1/06* (2013.01); *F28F 9/262* (2013.01); *F28F 2260/02* (2013.01); *Y10T 29/4935* (2015.01)

(58) Field of Classification Search

CPC ..... F28F 9/262; F28D 1/05333

USPC ..... 165/144, 175

See application file for complete search history.

(56) References Cited

U.S. PATENT DOCUMENTS

| | | | | |
|---|---|---|---|---|
| 1,899,629 | A * | 2/1933 | Morse | 165/144 |
| 2,191,146 | A * | 2/1940 | Mitchell | 165/175 |
| 3,447,598 | A * | 6/1969 | Kaess, Jr. | 165/67 |
| 4,292,958 | A * | 10/1981 | Lee | 165/175 |
| 2005/0161202 | A1 | 7/2005 | Merkys et al. | |
| 2009/0084131 | A1 | 4/2009 | Reifel et al. | |
| 2010/0254081 | A1 | 10/2010 | Koenig et al. | |
| 2010/0294460 | A1 | 11/2010 | Duchet-Annez et al. | |
| 2011/0056668 | A1 | 3/2011 | Taras et al. | |

FOREIGN PATENT DOCUMENTS

| | | | |
|---|---|---|---|
| EP | 1 557 622 | A2 | 7/2005 |
| FR | 2 923 594 | A1 | 5/2009 |
| JP | 2001124490 | A | 5/2001 |
| WO | 2009/007168 | A1 | 1/2009 |
| WO | 2009/134760 | A2 | 5/2009 |

* cited by examiner

*Primary Examiner* — Leonard R Leo
(74) *Attorney, Agent, or Firm* — Baker Botts L.L.P.

(57) ABSTRACT

The present application provides a microchannel coil manifold system. The microchannel coil manifold system may include a number of assembly inlet manifold sections that terminate in a first stub tube, a number of assembly outlet manifold sections that terminate in a second stub tube, and one or more microchannel coils. Each pair of assembly inlet and outlet manifold sections may be in communication with the one or more microchannel coils.

16 Claims, 5 Drawing Sheets

MICROCHANNEL COIL MANIFOLD SYSTEM

RELATED APPLICATIONS

The present application claims priority to U.S. Provisional Application Ser. No. 61/286,851 filed on Dec. 16, 2009. This application is incorporated herein by reference in full.

TECHNICAL FIELD

The present application relates generally to air conditioning and refrigeration systems and more particularly relates to a microchannel coil manifold system that permits the connection of multiple microchannel coils.

BACKGROUND OF THE INVENTION

Modern air conditioning and refrigeration systems provide cooling, ventilation, and humidity control for all or part of an enclosure such as a building, a cooler, and the like. Generally described, the refrigeration cycle includes four basic stages to provide cooling. First, a vapor refrigerant is compressed within a compressor at high pressure and heated to a high temperature. Second, the compressed vapor is cooled within a condenser by heat exchange with ambient air drawn or blown across a condenser coil by a fan and the like. Third, the liquid refrigerant is passed through an expansion device that reduces both the pressure and the temperature of the liquid refrigerant. The liquid refrigerant is then pumped within the enclosure to an evaporator. The liquid refrigerant absorbs heat from the surroundings in an evaporator coil as the liquid refrigerant evaporates to a vapor. Finally, the vapor is returned to the compressor and the cycle repeats. Various alternatives on this basic refrigeration cycle are known and also may be used herein.

Traditionally, the heat exchangers used within the condenser and the evaporator have been common copper tube and fin designs. These heat exchanger designs often were simply increased in size as cooling demands increased. Changes in the nature of the refrigerants permitted to be used, however, have resulted in refrigerants with distinct and sometimes insufficient heat transfer characteristics. As a result, further increases in the size and weight of traditional heat exchangers also have been limited within reasonable cost ranges.

As opposed to copper tube and fin designs, recent heat exchanger designs have focused on the use of aluminum microchannel coils. Microchannel coils generally include multiple flat tubes with small channels therein for the flow of refrigerant. Heat transfer is then maximized by the insertion of angled and/or louvered fins in between the flat tubes. The flat tubes are then joined with a number of manifolds. Compared to known copper tube and fin designs, the air passing over the microchannel coil designs has a longer dwell time so as to increase the efficiency and the rate of heat transfer. The increase in heat exchanger effectiveness also allows the microchannel heat exchangers to be smaller while having the same or improved performance and the same volume as a conventional heat exchanger. Microchannel coils thus provide improved heat transfer properties with a smaller size and weight, provide improved durability and serviceability, improved corrosion protection, and also may reduce the required refrigerant charge by up to about fifty percent (50%).

Microchannel coils generally are connected to the refrigeration system as a whole via an assembly or a refrigerant inlet manifold on one side of the coil and an assembly or a refrigerant outlet manifold on the other side. The microchannel coils may be connected in series, in parallel, or combinations thereof. The refrigerant inlet and outlet manifolds, however, should be able to accommodate these various configurations while permitting ease of installation, access, repair, removal, and/or reconfiguration and the like.

There is a desire therefore for an improved microchannel coil manifold system. Such an improved system should accommodate as many microchannel coils in as many different configurations as may be desired. Preferably, the manifold system may allow the easy reconfiguration of the microchannel coils in the field as well as in the factory.

SUMMARY OF THE INVENTION

The present application thus provides a microchannel coil manifold system. The microchannel coil manifold system may include a number of assembly inlet manifold sections that terminate in a first stub tube, a number of assembly outlet manifold sections that terminate in a second stub tube, and one or more microchannel coils. Each pair of assembly inlet and outlet manifold sections may be in communication with the one or more microchannel coils.

The microchannel coil manifold system further may include a coil manifold in communication with each microchannel coil and one of the assembly inlet manifold sections and one of the assembly outlet manifold sections. The coil manifold may include a coil manifold inlet brazed to an assembly inlet manifold section and a coil manifold outlet brazed to an assembly outlet manifold section. Each of the assembly inlet manifold sections and each of the assembly outlet manifold sections may be in communication with a pair of microchannel coils. A number of manifold coils may be used. Each stub tube may include a plug.

The microchannel coil manifold system further may include a frame with a slot. The microchannel coil may be positioned within the slot and the microchannel coil manifold system may be attached to the frame. The microchannel coil manifold system further may include a coil manifold in communication with each microchannel coil. The manifold coil may be attached to the frame via a coil attachment. The microchannel coil may slide within the slot. The microchannel coil may include a number of flat microchannel tubes with a number of fins extending therefrom. The microchannel coil may include an extruded aluminum.

The present application further may provide a method of installing a microchannel coil within a microchannel coil condenser assembly. The method may include the steps of attaching a first assembly inlet manifold section and a first assembly outlet manifold section to the microchannel coil, removing a first stub tube from the first assembly inlet manifold section and a second stub tube from the first assembly outlet manifold section, and attaching the first assembly inlet manifold section and the first assembly outlet section to a second assembly inlet manifold section and a second assembly outlet manifold section.

The method further may include the step of sliding the microchannel coil within a slot of a condenser assembly frame, attaching a coil manifold of the microchannel coil to a first end of the frame via a coil attachment, brazing an attachment between the coil manifold of the microchannel coil and the first assembly inlet manifold section and the first assembly outlet section, and installing a number of microchannel coils within the microchannel coil condenser assembly.

The present application further may provide for a microchannel coil condenser assembly. The microchannel coil condenser assembly may include a frame, a number of microchannel coils positioned within the frame, and a microchannel coil manifold system attached to the frame. The microchannel coil manifold system may include a number of assembly inlet manifold sections and a number of assembly outlet manifold sections. Each pair of assembly inlet and outlet manifold sections may be in communication with one or more microchannel coils.

The assembly inlet manifold sections may terminate in a first stub tube and the assembly outlet manifold sections may terminate in a second stub tube. The microchannel coil condenser. assembly further may include a coil manifold in communication with each microchannel coil and one of the assembly inlet manifold sections and one of the assembly outlet sections. The coil manifold may include a coil manifold inlet brazed to one of the assembly inlet manifold sections and a coil manifold outlet brazed to one of the assembly manifold outlet sections.

These and other features and improvements of the present application will become apparent to one of ordinary skill in the art upon review of the following detailed description when taken in conjunction with the several drawings and the appended claims.

DETAILED DESCRIPTION

Figure 1:
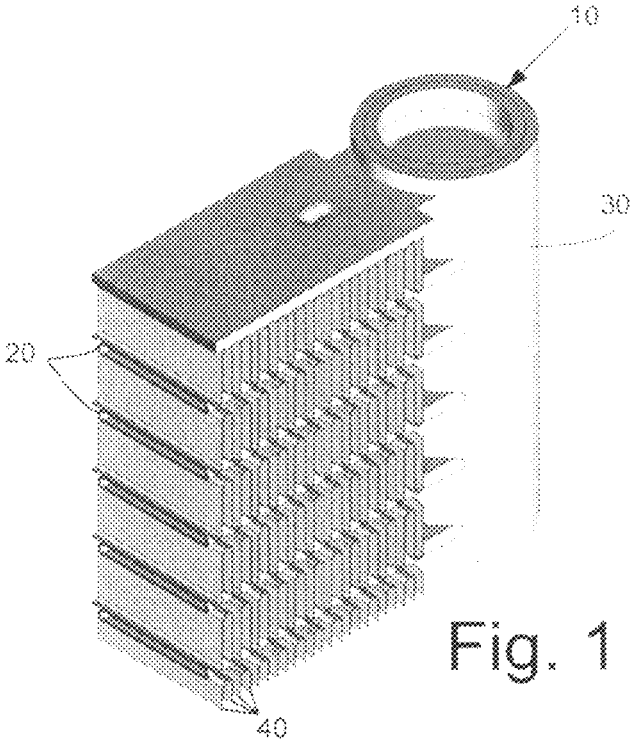
FIG. 1 is a perspective view of a portion of a microchannel coil as may be used herein.
Figure 2:
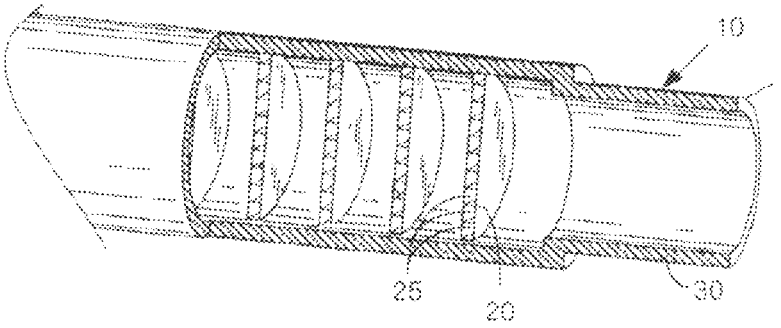
FIG. 2 is a side cross-sectional view of a portion of the microchannel coil of FIG. 1.

Referring now to the drawings, in which like numerals refer to like elements throughout the several views, FIGS. 1 and 2 show a portion of a known microchannel coil 10 similar to that described above. Specifically, the microchannel coil 10 may include a number of microchannel tubes 20 with a number of microchannels 25 therein. The microchannel tubes 20 generally are elongated and substantially flat. Each microchannel tube 20 may have any number of microchannels 25 therein. A refrigerant flows through the microchannels 25 in various directions.

The microchannel tubes 20 generally extend from one or more manifolds 30. The manifolds 30 may be in communication with the overall air-conditioning system as is described above. Each of the microchannel tubes 20 may have a number of fins 40 positioned thereon. The fins 40 may be straight or angled. The combination of a number of small tubes 20 with the associated high density fins 40 thus provides more surface area per unit volume as compared to known copper fin and tube designs for improved heat transfer. The fins 40 also may be louvered over the microchannel tubes 20 for an even further increase in surface area. The overall microchannel coil 10 generally is made out of extruded aluminum and the like.

Examples of known microchannel coils 10 include those offered by Hussmann Corporation of Bridgeton, Mo.; Modine Manufacturing Company of Racine, Wis.; Carrier Commercial Refrigeration, Inc. of Charlotte, N.C.; Delphi of Troy, Mich.; Danfoss of Denmark; and from other sources. The microchannel coils 10 generally may be provided in standard or predetermined shapes and sizes. Any number of microchannel coils 10 may be used together, either in parallel, series, or combinations thereof. Various types of refrigerants may be used herein.

Figure 3:
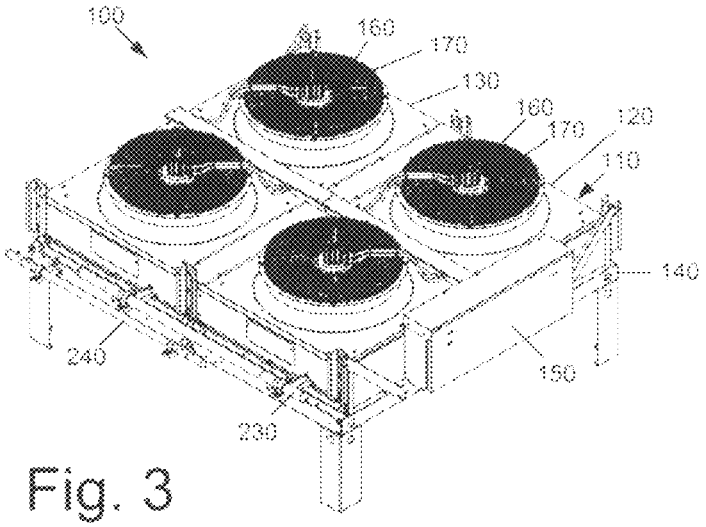
FIG. 3 is a perspective view of a microchannel condenser assembly as is described herein.

FIG. 3 shows a microchannel condenser assembly 100 as may be described herein. The microchannel condenser assembly 100 may include a number of microchannel coils 110. The microchannel coils 110 may be similar to the microchannel coil 10 described above or otherwise. Although two (2) microchannel coils 110 are shown, a first microchannel coil 120 and a second microchannel coil 130, any number of microchannel coils 110 may be used herein. As described above, the microchannel coils 110 may be connected in series, in parallel, or otherwise.

The microchannel coils 110 may be supported by a frame 140. The frame 140 may have any desired shape, size, or configuration. The frame 140 also may be modular as is described in more detail below. Operation of the microchannel coils 110 and the microchannel condenser assembly 100 as a whole may be controlled by a controller 150. The controller 150 may or may not be programmable. A number of fans 160 may be positioned about each microchannel coil 110 and the frame 140. The fans 160 may direct a flow of air across the microchannel coils 110. Any number of fans 160 may be used herein. Other types of air movement devices also may be used herein. Each fan 160 may be driven by an electrical motor 170. The electrical motor 170 may operate via either an AC or a DC power source. The electrical motors 170 may be in communication with the controller 150 or otherwise.

Figure 4:
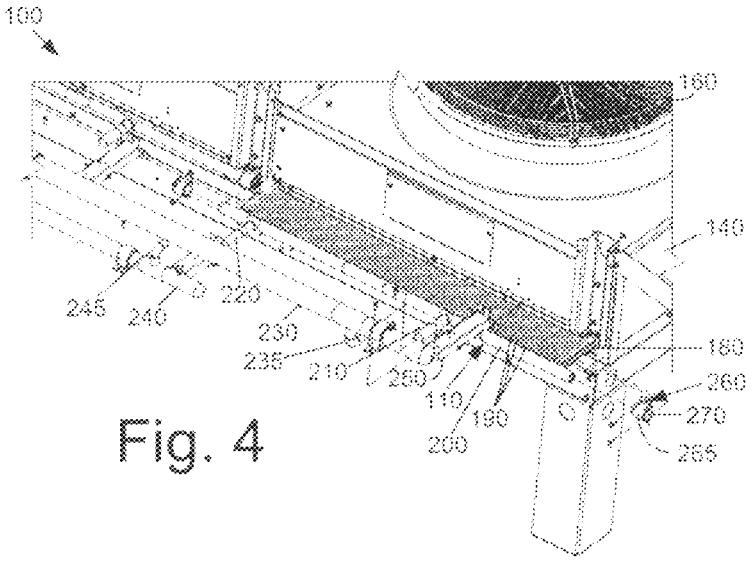
FIG. 4 is a partial exploded view of a microchannel coil being installed within the microchannel condenser assembly of FIG. 3.

FIG. 4 shows the insertion of one of the microchannel coils 110 into a slot 180 within the frame 140 of the microchannel condenser assembly 100. As is shown and as is described above, the microchannel coil 110 includes a number of microchannel tubes 190 in communication with a coil manifold 200. The coil manifold 200 has at least one coil manifold inlet 210 and at least one a coil manifold outlet 220. Refrigerant passes into the microchannel coil 110 via the coil manifold inlet 210, passes through the microchannel tubes 190 with the microchannels therein, and exits via the coil manifold outlet 220. The refrigerant may enter as a vapor and exit as a liquid as the refrigerant exchanges heat with the ambient air. The refrigerant also may enter as a liquid and continue to release heat therein.

The microchannel condenser assembly 100 likewise may include an assembly inlet manifold 230 with an assembly inlet connector 235 and an assembly outlet manifold 240 with an assembly outlet connector 245. The assembly inlet manifold 230 is in communication with the coil manifold 200 via the coil manifold inlet 210 and the assembly inlet connector 235 while the assembly outlet manifold 240 is in communication with the coil manifold 200 via the coil outlet manifold 220 and the assembly outlet connector 245. Other connections may be used herein. The assembly manifolds 230, 240 may be supported by one or more brackets 250 or otherwise. The assembly manifolds 230, 240 may be in communication with other elements of the overall refrigeration system as was described above.

The coil manifold inlets and outlets 210, 220 and/or the assembly connectors 235, 245 may include stainless steel with copper plating at one end. The coil inlets and outlets 210, 220 and the assembly connectors 235, 245 may be connected via a brazing or welding operation and the like. Because the copper and the aluminum do not come in contact with one another, there is no chance for galvanic corrosion and the like. Other types of fluid-tight connections and/or quick release couplings also may be used herein.

Figure 5:
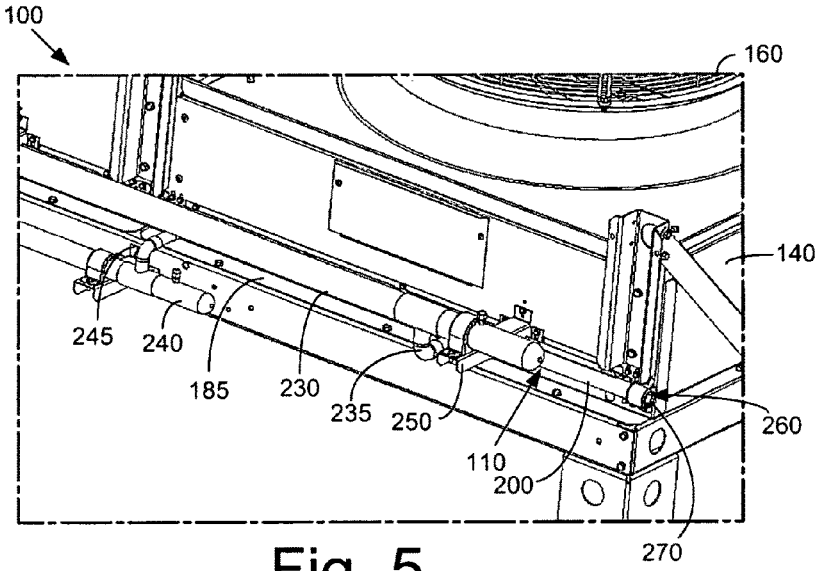
FIG. 5 is a partial perspective view of the microchannel coil installed at a first end of the microchannel condenser assembly of FIG. 3.

FIG. 5 shows one of the microchannel coils 110 installed within the slot 180 of the frame 140 at a first end 185 thereof. As described above, the coil manifold 200 may be in communication with the assembly inlet and outlet manifolds 230, 240. The coil manifold 200 also may be attached to the frame 140 at the first end 185 via a coil attachment 260. The coil attachment 260 may include a clamp 265 that surrounds the coil manifold 200 and is secured to the frame 140 via screws, bolts, other types of fasteners, and the like. Other shapes may be used herein. A rubber or polymeric bushing 270 also may be used between the manifold 200 and the clamp 265 so as to dampen any vibrations therein. Other types of isolation means may be used herein.

Figure 6:
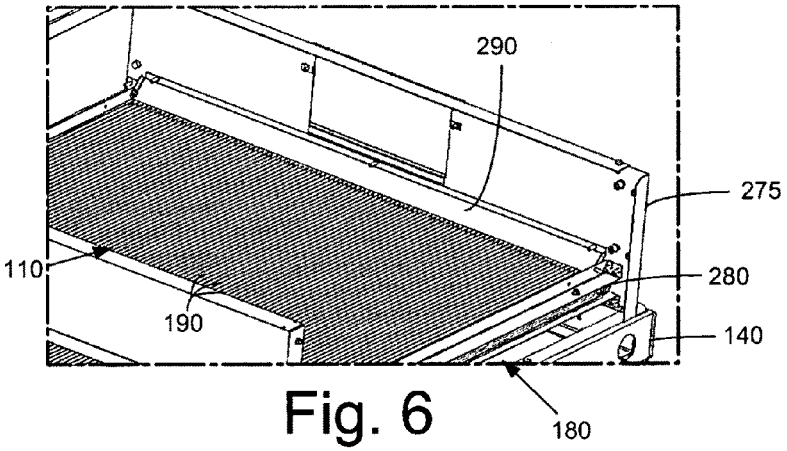
FIG. 6 is a partial perspective view of the microchannel coil attached at a second end of the microchannel condenser assembly of FIG. 3.

FIG. 6 shows the opposite end of the microchannel coil 110 as installed within the slot 180 at a second end 275 of the frame 140. The slot 180 may extend for the length of the frame 140 or otherwise. The microchannel coil 110 may slide along the slot 180. Alternatively, wheels and/or other types of motion assisting devices may be used herein. The microchannel coil 110 may be held in place via a rear bracket or a tab 290. The rear bracket 290 may be any structure that secures the microchannel coil 110 in place. The rear bracket 290 may be secured to the back of the frame 140 once the microchannel coil 110 has been slid therein. Other types of attachment means and/or fasteners may be used herein.

Figure 7:
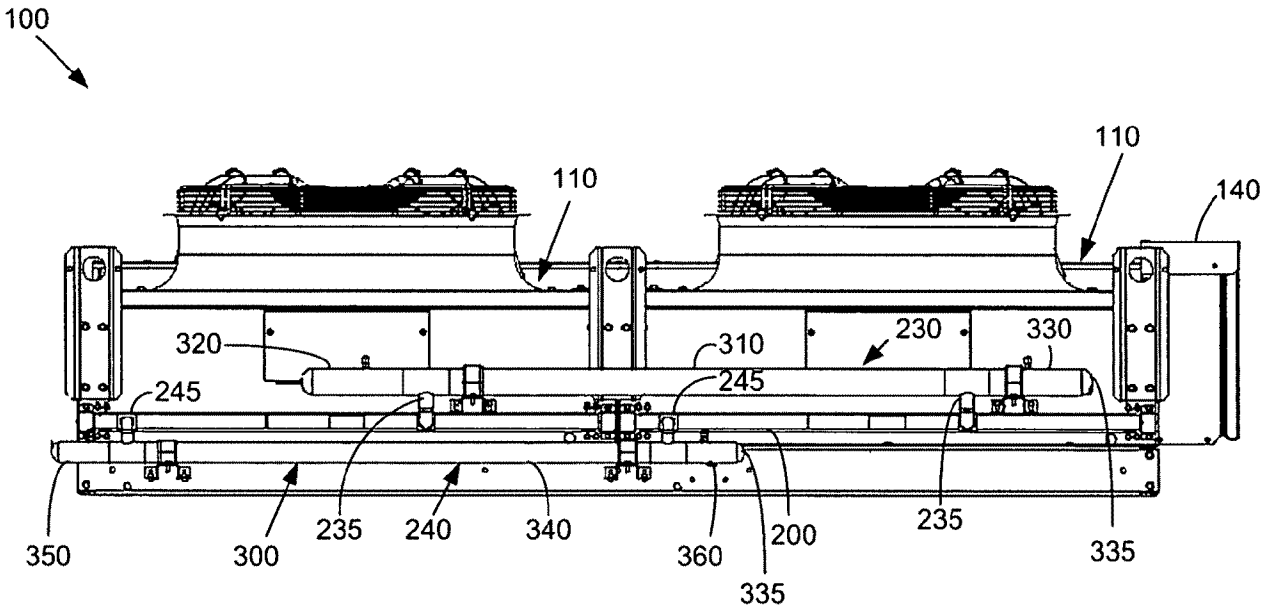
FIG. 7 is a side plan view of the microchannel coil manifold system as may be described herein.

FIG. 7 shows a microchannel coil manifold system 300 as is described herein. As is shown, the microchannel coil manifold system 300 may include the coil manifold 200 as well as the assembly inlet manifold 230 and the assembly outlet manifold 240. In this case, the assembly inlet manifold 230 may include a number of assembly inlet manifold sections 310. Each of the assembly inlet manifold sections 310 may include a number of stub tubes, a first end stub tube 320 and a second end stub tube 330. Each stub tube 320, 330 may be positioned at an end of each manifold section 310 and generally adjacent to the assembly inlet and outlet connectors 235, 245. Other positions may be used herein. The stub tubes 320, 330 may enclose each end of the manifold section 310 as is shown. A stopper such as a plug 335 or other type of enclosing means also may be used herein. Likewise, the microchannel coil manifold system 300 also may include a number of assembly outlet manifold sections 340. The assembly outlet manifold sections 340 also each may include a first stub tube 350 and a second end stub tube 360.

In use, one end of each assembly manifold 230, 240 of the microchannel coil manifold system 300 will be connected to the refrigeration system as a whole and the other end will terminate at a stub tube 320, 330, 350, 360. Other configurations may be used herein.

Figure 8:
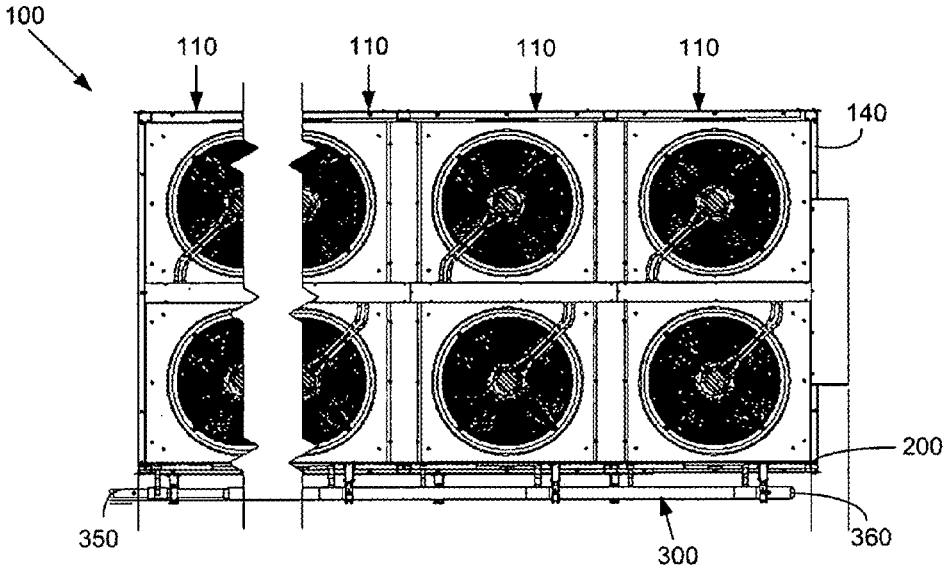
FIG. 8 is a top plan view of a microchannel coil condenser assembly with the microchannel coil manifold system of FIG. 7.
Figure 9:
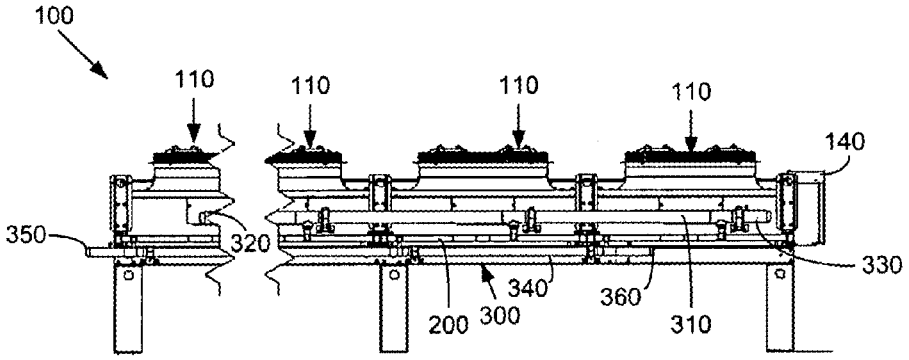
FIG. 9 is a side plan view of the microchannel coil condenser assembly of FIG. 8.

As is shown in FIGS. 8 and 9, the microchannel coil condenser assembly 100 may include as many microchannel coils 110 as may be desired. Through the use of the microchannel coil manifold system 300, the stub tubes 320, 330 of the assembly inlet manifold section 310 may be removed and additional assembly inlet manifold sections 310 may be connected thereto. Likewise, the stub tubes 350, 360 of the assembly outlet manifold section 340 may be removed and additional assembly outlet manifold sections 340 may be connected as desired. The additional microchannel coils 110 then may be connected to the assembly manifold sections 310, 340 as is described above. The frame 140 may be modular in construction so as to accommodate the addition or removal of the microchannel coils 110.

Not only does the use of the microchannel coil manifold system 300 allow for the connection of as many microchannel coils 110 as may be desired, but the combination of the microchannel manifold system 300 and the ability to slide the microchannel coils 110 into the frame 140 via the slot 180 further provides ease of access for installation, removal, and repair. Moreover, the microchannel condenser assembly 100 as a whole may be more compact given the use of manifolding only on one side of the microchannel coils 110. Further, although the microchannel coils 110 are positioned on one side of the microchannel coil manifold system 300, the microchannel coils 110 themselves may be positioned on both sides of the microchannel coil system 300 if desired, providing an even more compact system as a whole.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. An expandable microchannel coil system, comprising:
a plurality of modular assembly inlet manifold sections;
wherein the plurality of modular assembly inlet manifold sections terminate in an inlet stub tube;
a plurality of modular assembly outlet manifold sections;
wherein the plurality of modular assembly outlet manifold sections terminate in an outlet stub tube;
a plurality of microchannel coils; and
a plurality of coil manifolds;
wherein one of the plurality of coil manifolds is in communication with one of the plurality of microchannel coils on a first side thereof and in communication with one of the plurality of modular assembly inlet manifold sections and one of the plurality of modular assembly outlet manifold sections on the first side.

2. The microchannel coil system of claim 1, wherein the coil manifold comprises a coil manifold inlet brazed to an assembly inlet manifold section and a coil manifold outlet brazed to an assembly outlet manifold section.

3. The microchannel coil system of claim 1, wherein each of the plurality of assembly inlet manifold sections and each of the plurality of assembly outlet manifold sections is in communication with a pair of microchannel coils.

4. The microchannel coil system of claim 1, wherein each stub tube comprises a plug.

5. The microchannel coil system of claim 1, further comprising a frame with a slot and wherein the microchannel coil is positioned within the slot and attached to the frame.

6. The microchannel coil system of claim 5, wherein the manifold coil is attached to the frame via a coil attachment.

7. The microchannel coil system of claim 5, wherein the microchannel coil slides within the slot.

8. The microchannel coil system of claim 1, wherein each of the plurality of microchannel coils comprises a plurality of flat microchannel tubes with a plurality of fins extending therefrom.

9. The microchannel coil system of claim 1, wherein each microchannel coil comprises an extruded aluminum.

10. A method of installing a microchannel coil within a microchannel coil condenser assembly, comprising:

attaching a first modular assembly inlet manifold section and a first modular assembly outlet manifold section to the microchannel coil via a coil manifold on a first side of the microchannel coil;

removing a first stub tube of the first modular assembly inlet manifold section and a second stub tube of the first modular assembly outlet manifold section; and attaching the first modular assembly inlet manifold section and the first modular assembly outlet section to a second modular assembly inlet manifold section and a second modular assembly outlet manifold section.

11. The method of installing of claim 10, further comprising the step of sliding the microchannel coil within a slot of a condenser assembly frame.

12. The method of installing of claim 10, further comprising the step of attaching the coil manifold of the microchannel coil to a first end of the frame via a coil attachment.

13. The method of installing of claim 12, further comprising brazing an attachment between the coil manifold of the microchannel coil and the first assembly inlet manifold section and the first assembly outlet section.

14. The method of installing of claim 10, further comprising the step of installing a plurality of microchannel coils within the microchannel coil condenser assembly.

15. An expandable microchannel coil condenser assembly, comprising:

a frame;

a plurality of microchannel coils positioned within the frame; and a microchannel coil manifold system attached to the frame;

wherein the microchannel coil manifold system comprises a plurality of modular assembly inlet manifold sections and a plurality of modular assembly outlet manifold sections;

wherein the plurality of assembly inlet manifold sections terminate in an inlet stub tube and wherein the plurality of assembly outlet manifold sections terminate in an outlet stub tube; and a plurality of coil manifolds;

wherein one of the coil manifolds is in communication with one of the plurality of microchannel coils on a first side thereof and in communication with one of the plurality of modular assembly inlet manifold sections and one of the plurality of modular assembly outlet manifold sections on the first side.

16. The microchannel coil condenser assembly of claim 15, wherein the coil manifold comprises a coil manifold inlet brazed to one of the plurality of assembly inlet manifold sections and a coil manifold outlet brazed to one of the plurality of assembly manifold outlet sections.

* * * * *